US006331154B1

(12) United States Patent
Shibuya et al.

(10) Patent No.: US 6,331,154 B1
(45) Date of Patent: Dec. 18, 2001

(54) PIN ACTION TIMING ADJUSTMENT DEVICE IN FOLDING CYLINDER AND FOLDING DEVICE

(75) Inventors: Kazuaki Shibuya; Tomonari Nakajima, both of Kawasaki; Seiji Suzuki, Yokohama, all of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/417,997

(22) Filed: Oct. 13, 1999

(30) Foreign Application Priority Data

Jul. 15, 1999 (JP) ..... 11-202202

(51) Int. Cl.[7] ..... B31P 1/08
(52) U.S. Cl. ..... 493/424; 493/426; 493/476
(58) Field of Search ..... 443/476, 231, 443/243, 397, 405, 424, 434, 444, 426, 429

(56) References Cited

U.S. PATENT DOCUMENTS 3,865,361 * 2/1975 Neal .
4,629,445 * 12/1986 Toriyama .
4,790,804 * 12/1988 Gotou et al. .
5,697,881 * 12/1997 Nishihara .
6,165,118 * 12/2000 Eckert .

FOREIGN PATENT DOCUMENTS 46-10123 3/1971 (JP) .
56-18500 4/1981 (JP) .
7-29726 3/1988 (JP) .

* cited by examiner

*Primary Examiner*—Eugene Kim
(74) *Attorney, Agent, or Firm*—Greenblum & Bernstein, P.L.C.

(57) ABSTRACT

In a pin action timing adjustment device of a folding device wherein a change-over between straight run and collect run is performed in one operation for a folding blade action and a pin action, to make it very easy to adjust a timing with which pins fall relative to the projection of folding blades, to make a mechanism very simple, to largely reduce manufacturing costs, to effectively eliminate the occurrence of faults so that maintenance is easy, and to provide an adjusting mechanism which permits ample adjustment tolerance. A control means is connected to a pin action stop cam which causes the pin action stop cam to undergo an angular displacement around its center line, and a stop means which can be connected to the pin action stop cam which has undergone an angular displacement due to the control means and stops the pin action stop cam with a phase displaced by the control means.

7 Claims, 3 Drawing Sheets

PIN ACTION TIMING ADJUSTMENT DEVICE IN FOLDING CYLINDER AND FOLDING DEVICE

SUMMARY OF THE INVENTION

Field of the Invention

This invention relates to a pin action timing adjustment device of a folding device. More specifically, it relates to a device which adjusts the timing of pins and blades that hold and release paper folded on the circumferential surface of a folding cylinder, in a folding cylinder comprising plural pin mechanisms and an identical number of folding blade mechanisms.

In particular, it relates to a pin action timing adjustment device of a folding device wherein the operating mode can be changed over between straight run and collect run.

BACKGROUND OF THE INVENTION

Folding devices of rotary presses which print, cut and fold printing web, for example, can fold paper in two folding modes, i.e., straight run or collect run.

The printing web, which is transported between a folding cylinder and cutting cylinder that rotate via a pair of nipping rollers, is cut to a desired length, and is thereby made into cut printed product.

The non-printing area of the paper slightly upstream from the cutting position is pierced by and held by pins which extend from the folding cylinder surface, and is progressively wound onto the fixed circumferential surface part of the folding cylinder due to the rotation of the folding cylinder. The folding cylinder undergoes an angular displacement by a predetermined angle, and whenever the approximate middle part of the wound, cut printed product reaches the nearest position to the downstream adjacent cylinder (jaw cylinder), folding blades project from the folding cylinder circumferential surface, push up the approximate middle part (the fold) of the cut printed product, and transfer it to a jaw mechanism provided on the circumferential surface of an adjacent cylinder (jaw cylinder) situated facing the folding blades (straight run).

Alternatively, the folding blades project from the folding cylinder circumferential surface, push up the approximate midpart (the fold) of the cut printed product, and transfer it to the jaw mechanism provided on the circumferential surface of the downstream adjacent cylinder (jaw cylinder) facing the folding blades on every other occasion when the approximate middle part of the cut printed product reaches the aforesaid nearest position (collect run). At the time of this transfer, the pins which held the leading edge of this cut printed product fall away from the circumferential surface of the folding cylinder circumferential surface, releasing the cut printed product.

However, in either of the above folding modes, if the timing with which the pins released the cut printed product was too early, the cut printed product was not fully advanced, and it creased or crumpled when it was transferred. Moreover, the position of the fold in the cut printed product could not be maintained constant.

Conversely, if the timing with which the pins released the cut printed product was too late, as the cut printed product was restrained by the pins, the pin holes in the cut printed product were enlarged and the paper tore.

The grip on the cut printed product by the jaw mechanism of the adjacent cylinder (jaw cylinder) was then inadequate, causing the paper to slip so that it was not transferred properly.

In order to prevent such problems, a device is needed to adjust the timing of the pins falling from the folding cylinder circumferential surface relative to the rising of the folding blades from the circumferential surface of the folding cylinder. Such a device is disclosed for example in Japanese Patent Publication No.46-10123 (Koho) and Japanese Patent Publication No.7-29726 (Koho).

In the timing adjustment of the projection of the folding blades and falling of the pins shown in Japanese Patent Publication No.46-10123 (Koho), engaging parts of helical gears are provided in the drive path of a pin action cam. One of these engaged helical gears is free to displace parallel to a rotating shaft, and the adjustment is performed by displacing this gear.

The pin action cam has the same rotation center as the rotation center of the folding cylinder, and has the same drive source as that of the folding cylinder. The pin action may be changed over between straight run and collect run by selectively changing over so that rotation is performed at either one of two predetermined rotation speed ratios relative to the rotation of the folding cylinder.

A cam follower is provided free to rotate via a cam follower shaft at the free end of an arm installed at the end of a pin action shaft parallel to the axis of the folding cylinder in the folding cylinder, and is made to come into contact with a cam surface of the aforesaid pin action cam.

The pin action cam rotates together with the rotation of the folding cylinder with a selected rotational speed ratio, and due to the displacement of the cam follower depending on this pin action cam, the pin action shaft displaces back and forth so that the pins attached to the cam action shaft rise and set on the circumferential surface of the folding cylinder.

As the folding cylinder rotates, the folding blades then either project from the circumferential surface of the folding cylinder on each occasion (straight run) or project from the circumferential surface of the folding cylinder on every other occasion (collect run) that the folding cylinder reaches a predetermined rotation phase.

However, the change-over of this projection operation is performed independently of the change-over of rotation speed ratio of the pin action cam (change-over between straight run and collect run of the pin action).

Specifically, this folding device comprises a mechanism which enables it to change the rotation phase of the driven side relative to the rotation of the drive side using the torsion angle of the teeth of the helical gear in the drive path for driving the rotation of the pin action cam. By controlling this mechanism, the rotation phase of the pin action cam is changed relative to the rotation of the folding cylinder having the same drive source, and the timing with which the pins fall from the circumferential surface of the folding cylinder relative to the projection of the folding blades, which project from the circumferential surface of the folding cylinder with a desired timing relative to the rotation of the folding cylinder, is adjusted.

Next, the timing adjustment with which the pins fall relative to the projection of the folding blades disclosed in Japanese Patent Laid-Open Hei 7-29726 (Koho), is made by providing a change-over mechanism in the drive path of the pin action cam. This mechanism, which changes over between stop and rotation of the pin action cam by connecting or disconnecting the drive path, comprises a helical gear which transmits the rotation of the drive source downstream when the drive path is connected and stops in a fixed state when the drive path is disconnected. A helical gear which engages with this helical gear is provided downstream in the drive path of the pin action cam such that it is free to displace parallel to its rotation axis. By displacing this gear, the pin action cam which is in the stop state can be made to undergo an angular displacement to change its phase, or the rotation phase of the driven side relative to the rotation of the drive side can be changed using the torsion angle of the teeth of the helical gear.

A pin action cam, which has the same rotation center as the rotation center of the folding cylinder and has the same drive source as the folding cylinder, can change over between straight run and collect run by selectively changing over between stop with a predetermined rotation phase, and rotation under a predetermined rotation speed ratio relative to the rotation of the folding cylinder.

A pin cam follower is installed free to rotate via a cam follower shaft at the free end of an arm provided on the end of the pin cam shaft parallel to the axis of the folding cylinder in the folding cylinder, and is brought into contact with the cam surface of the aforesaid pin action cam. Due to the displacement of the pin cam follower due to the pin action cam in the stop-state or which rotates with a predetermined rotation speed ratio relative to the rotation of the folding cylinder, the pin action shaft moves back and forth, and the pins connected to the pin action shaft rise and set on the circumferential surface of the folding cylinder.

At this time, folding blades project from the circumferential surface of the folding cylinder on each occasion (straight run) or project from the circumferential surface of the folding cylinder on every other occasion (collect run) that the folding cylinder attains a predetermined rotation phase as the folding cylinder rotates.

However, the change-over of this projection action is performed separately from the change-over between stop and rotation of the pin action cam (i.e., change-over between straight run and collect run of the pin action).

Specifically, this folding device comprises a mechanism which causes the pin action cam in the stop state to undergo an angular displacement to change its phase, or change the rotation phase of the driven side relative to the rotation of the drive side using the torsion angle of the teeth of the helical gear in the drive path for rotating the pin action cam.

By controlling this mechanism, the stop phase or rotation phase of the pin action cam is changed relative to the rotation of the folding cylinder having the same drive source, and the timing with which the pins fall on the circumferential surface of the folding cylinder relative to the projection of the folding blades from the circumferential surface of the folding cylinder, which project with a desired timing relative to the rotation of the folding cylinder, is adjusted.

Moreover, this adjustment can be performed regardless of whether the pin action cam has stopped or is rotating.

In both of the above references in the prior art, the folding mode may be changed over between collect run and straight run, and a mechanism is provided which can adjust the pin action timing relative to the folding blade action timing in both of these folding modes. However, when the folding modes were changed over (change-over between straight run and collect run), the change-over of the folding blade action and the change-over of the pin action had to be performed separately. Therefore, a change-over operation had to be performed twice.

In addition to this, as the change-overs were performed separately, there was a considerable risk that the folding device would be operated after forgetting to change over either the folding blades or pins, and this posed a great problem in managing the device.

In this regard, a device has been proposed to perform the folding mode change-over operation only once, wherein change-over of the folding blade action and change-over of the pin action are performed in one operation by the same mechanism whenever a change-over occurs between straight run and collect run, as shown in, for example, Japanese Patent Laid-Open 56-18500 (Koho).

This folding device comprises a pin action fixed cam and folding blade action fixed cam installed at a suitable interval. These two fixed cams are fixed such that they are concentric with the rotation center of the folding cylinder, cam surfaces being formed on their outer circumferences.

This folding device further comprises a pin action rotation cam and folding blade action rotation cam provided in a one-piece construction between these two fixed cams. The pin action rotation cam has a cam surface on its outer circumference, and the pins are changed over between straight run and collect run by the joint action of this cam and the aforesaid pin action fixed cam. The folding blade action rotation cam also has a cam surface on its outer circumference, and the folding blades are changed over between straight run and collect run by the joint action of this cam and the aforesaid folding blade action fixed cam.

As the pin action rotation cam and folding blade action rotation cam are provided in a one-piece construction, both rotation cams can be stopped simultaneously. Further, as they can be rotated simultaneously, straight run and collect run may be selectively changed over by stopping these cams with a predetermined rotation phase at the same rotation center as the rotation center of the folding cylinder (straight run), or rotating them under a predetermined rotation speed ratio relative to the rotation of the folding cylinder (collect run).

In this way, straight run and collect run can be selectively changed over.

This device further provides a pin cam follower and folding blade cam follower. The pin cam follower is provided free to rotate via a cam follower shaft at the free end of an arm installed at the end of a pin action shaft parallel to the axis of the folding cylinder in the folding cylinder, and is brought into contact with the cam surfaces of the aforesaid pin action fixed cam and pin action rotation cam. The folding blade cam follower is provided free to rotate via the cam follower shaft at the open end of an arm installed at the end of a folding blade action shaft parallel to the axis of the folding cylinder between two adjacent pin action shafts in the folding cylinder, and is brought into contact with the cam surfaces of the aforesaid folding blade action fixed cam and folding-blade action rotation cam. The two cam followers respectively displace according to these four cams including the aforesaid two fixed cams. As a result, the pin action shaft and folding blade action shaft move back and forth, and the pins connected to the pin action shaft and folding blades connected to the folding blade action shaft rise and set on the circumferential surface of the folding cylinder while maintaining a predetermined relation due to these cams.

When a change-over is performed between straight run and collect run, the action of both the pins and the folding blades can be changed over in one operation by changing over to either stop or rotation of the aforesaid two rotation cams formed in one piece.

However, in this folding device, unlike the folding devices of the aforesaid two examples, the timing of the rising and setting of the pins on the circumferential surface of the folding cylinder could not be adjusted relative to the projection of the folding blades from the circumferential surface of the folding cylinder.

RELATED ARTS

The related art described above had the following problems regarding timing adjustment of the projection and falling of the pins.

Firstly, in both of the devices shown in Japanese Patent Publication Sho 46-10123 (Koho) and Japanese Patent Publication Hei 7-29726 (Koho), a part is installed which engages with helical gears, and one of the helical gears so engaged is displaced parallel to its rotation axis to vary the phase of the pin action cam and change the timing of the pins, as described above. In this mechanism, in order to displace the helical gear, a screw mechanism must be provided to displace the gear via a bearing. This considerably increases the number of parts, and as a large number of moving parts are required together with parts requiring precision of the bearing box, etc., the manufacturing cost was relatively high. Moreover, due to the increase in the number of parts, maintenance was difficult.

Further, in this mechanism, since the adjustment depends on the torsion angle of a helical gear, the adjustment amount could not be increased. That is, although the variation in the phase of a pin action cam which can be obtained using the torsion angle of a helical gear is at most of the order of 10 degrees, rotary presses as a whole including recent folding devices are now required to have higher processing capacity and higher speed. In the face of these exigencies, the cam shape is made gently sloping to improve the tracking ability of the cam follower. However, with a displacement of about 10 degrees by the helical gear, an effective adjustment can no longer be obtained, and a mechanism providing a greater adjustment amount was desired.

Concerning this point, Japanese Patent Publication Hei 7-29726 (Koho) proposes using a differential gear system instead of the aforesaid mechanism which displaces a helical gear.

However, although a differential gear system is effective in increasing the adjustment amount, there is necessarily more parts than in a mechanism which displaces a helical gear, and parts requiring high accuracy also increase. This increased manufacturing costs and maintenance time more than was necessary.

Secondly, Japanese Patent Publication Sho 46-10123 (Koho) and Japanese Patent Publication Hei 7-29726 (Koho) propose an adjusting mechanism using helical gears of the above type. However, when a change-over was made between folding modes, i.e., between straight run and collect run, the change-over of the folding blade action and the change-over of the pin action had to be performed separately. As a result, a change-over operation had to be performed twice, and there was a risk of forgetting to perform one of the change-over operations which posed a serious problem in device control management.

From the viewpoint of solving this problem, Japanese Patent Publication Sho 56-18500 (Koho) suggests a method wherein change-over of the folding blade action and change-over of the pin action are performed in one operation.

However, in Japanese Patent Publication 56-18500 (Koho), there is no disclosure of anything in the mechanism to vary the timing with which the pins fall on the circumferential surface of the folding cylinder relative to the projection of the folding blades from the circumferential surface of the folding cylinder. Also, a timing adjustment mechanism is indispensable for controlling the device, and in recent years its implementation has come to be desired together with easier device maintenance.

In view of the above problems, it is a first object of this invention to permit very easy adjustment of the timing with which pins fall on the circumferential surface of a folding-cylinder relative to the projection of folding blades from the circumferential surface of the folding cylinder, in a device where the action of the folding blades and the action of the pins are changed over in one operation when there is a change-over between straight run and collect run.

In the adjustment using helical gears of the prior art, there was little adjustment tolerance. However, it is a second object of this invention to provide sufficient adjustment tolerance in the timing with which pins fall on the circumferential surface of a folding cylinder relative to the projection of folding blades from the circumferential surface of the folding cylinder, in a device where the action of the folding blades and the action of the pins are changed over in one operation when there is a change-over between straight run and collect run.

Further, it is a third object of this invention to achieve the first and second objects by means of a very simple construction, largely suppressing manufacturing costs and practically eliminating failures to allow for easy maintenance.

In order to solve the above problems, the first invention provides a pin action timing adjustment device for a folding cylinder, comprising:

a folding cylinder, plural pin mechanisms which cause pins provided in a folding cylinder to rise and set on the outer circumferential surface of the folding cylinder, plural folding blade mechanisms which cause folding blades to rise and set on the outer circumferential surface of the folding cylinder in conjunction with the rising and falling of the pins provided in the folding cylinder, a pin action stop cam having the same center as the rotation center of the folding cylinder, a folding blade action stop cam having the same center as the rotation center of the folding cylinder, a pin action rotation cam and folding blade action rotation cam formed in one piece having the same rotation center as the rotation center of the folding cylinder, which can selectively change over between a state wherein the cam rotates in a predetermined relation to the rotation of the folding cylinder and a state where it has stopped in a predetermined relation to the pin action stop cam and folding blade action stop cam, a pin cam follower provided in the pin mechanisms which causes the pins to rise and set on the outer circumferential surface of the folding cylinder together with the pin action stop cam and pin action rotation cam, a folding blade cam follower provided in the folding blade which causes the folding blades to rise and set on the outer circumferential surface of the folding cylinder together with the folding blade action stop cam and folding blade action rotation cam, control means linked to the pin action stop cam which causes the pin action stop cam to undergo an angular displacement around its center, and stop means which can be connected to the pin action stop cam, and which stops the pin action stop cam with a phase wherein it was displaced by the control means. In this way, the timing with which the pins fall on the circumferential surface of the folding cylinder relative to the projection of the folding blades from the circumferential surface of the folding cylinder can be very easily adjusted.

In this mechanism, moreover, sufficient tolerance can be obtained in the timing with which the pins f all on the circumferential surface of the folding cylinder relative to the projection of the folding blades from the circumferential surface of the folding cylinder.

Moreover, the mechanism which achieves these purposes has a very simple construction, largely suppressing manufacturing costs and practically eliminating failures which allows for easy maintenance.

To resolve the above problems, the second invention provides a pin action timing adjustment device for a folding device wherein, in the folding device in which a pin action and a folding blade action are changed over together when a change-over between straight run and collect run is made, the timing with which the pins fall on the circumferential surface of the folding cylinder relative to the projection of the folding blades from the circumferential surface of the folding cylinder can be very easily adjusted by providing a control means which causes the pin action stop cam to undergo an angular displacement around its center, and a stop means.

It further provides a mechanism wherein sufficient tolerance can be obtained in the timing with which the pins fall on the circumferential surface of the folding cylinder relative to the projection of the folding blades from the circumferential surface of the folding cylinder.

Moreover, the mechanism which achieves these purposes has a very simple construction, largely suppressing manufacturing costs and practically eliminating failures which allows for easy maintenance.

To resolve the above problems, the third invention provides a folding device comprising a cutting cylinder, folding cylinder and jaw cylinder, wherein the timing with which the pins fall on the circumferential surface of the folding cylinder relative to the projection of the folding blades from the circumferential surface of the folding cylinder can be very easily adjusted by providing a pin action timing adjustment device for a folding cylinder according to the first invention.

To resolve the above problems, the fourth invention provides a pin action timing adjustment device according to the first invention or second invention, wherein the stop means stops the pin action stop cam by locking the control means.

To resolve the above problems, the fourth invention provides a pin action timing adjustment device according to the first invention or second invention, wherein the stop means stops the pin action stop cam by locking the control means and by locking the pin action stop cam.

PREFERABLE EMBODIMENT OF THE INVENTION

Figure 1:
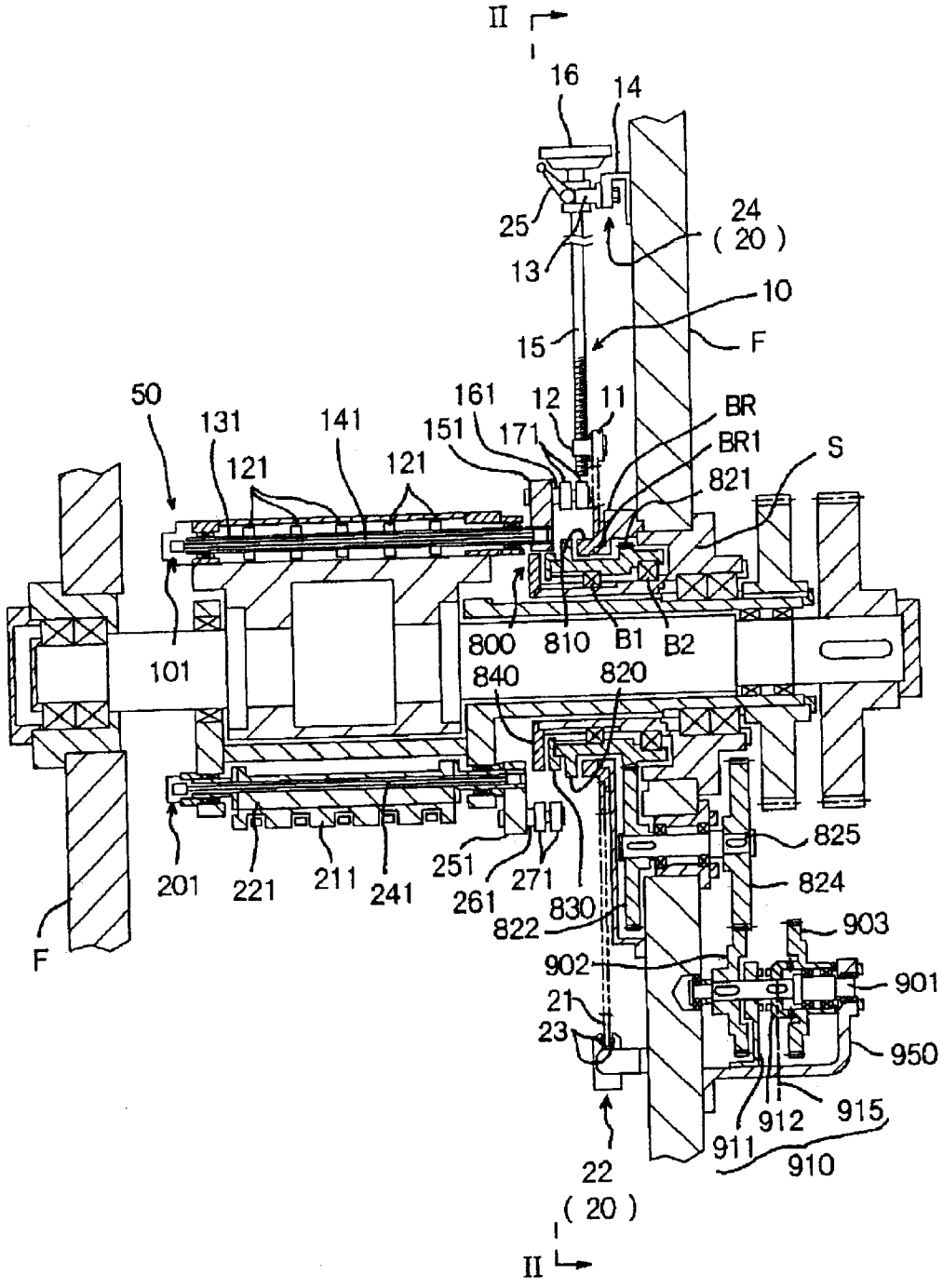
FIG. 1 is a schematic sectional view in a parallel arrangement showing parts relating to this invention of a folding cylinder which is one embodiment of a rotating cylinder according to this invention.

Next, some embodiments of this invention will be described referring to the drawings.

Figure 2:
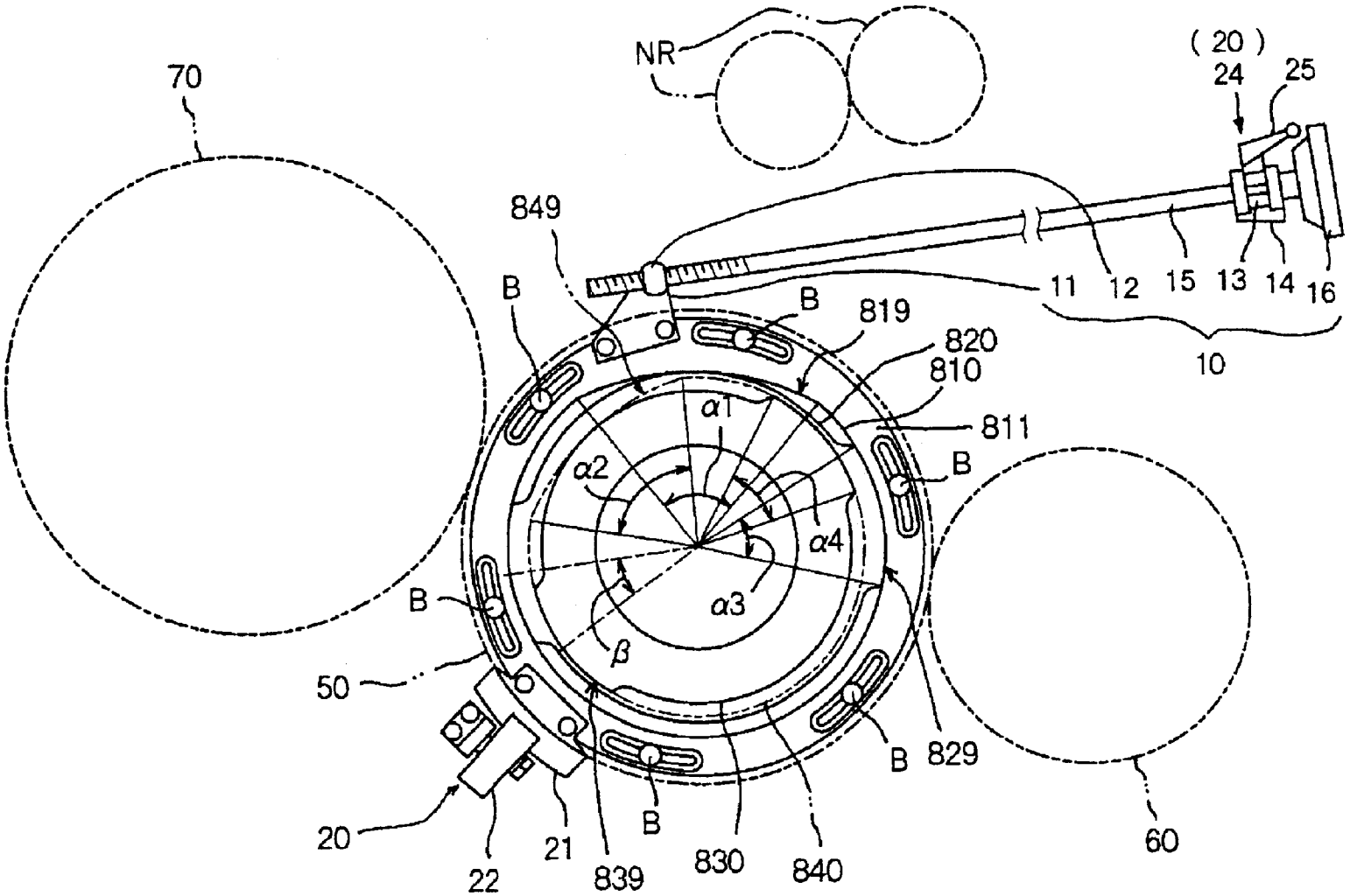
FIG. 2 is a schematic diagram showing parts relating to this invention along a line II—II in FIG. 1.
Figure 3:
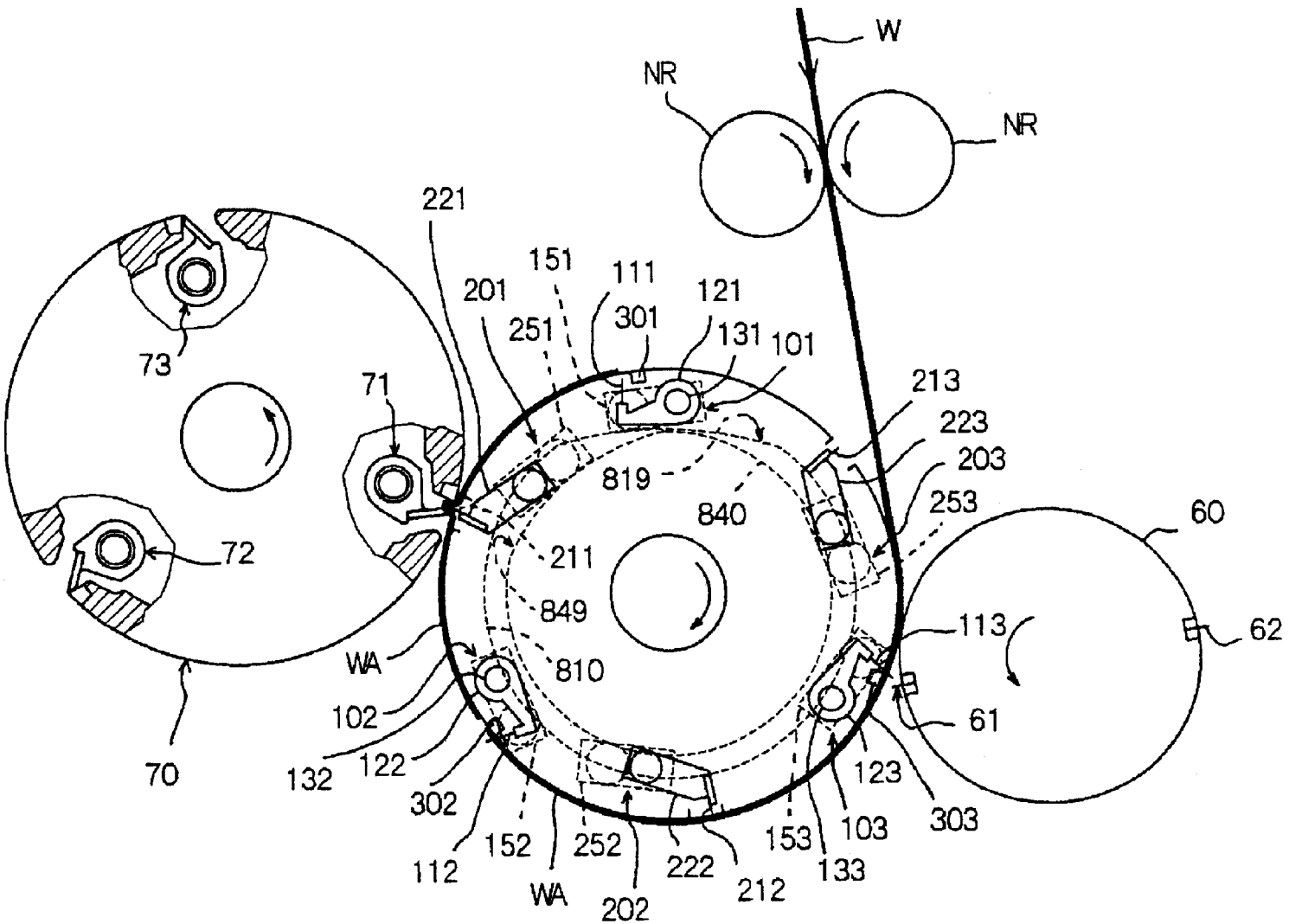
FIG. 3 is a schematic diagram showing an arrangement of rotating cylinders of a folding device comprising the folding cylinder shown in FIG. 1.

FIG.1 is a schematic parallel sectional view showing parts relating to this invention of a folding cylinder, which is one embodiment of a rotating cylinder according to this invention. FIG. 2 is a schematic view showing parts related to this invention along a line II—II in FIG. 1. FIG. 3 is a schematic view showing the arrangement of rotating cylinders in a folding device comprising the folding cylinder shown in FIG. 1. In FIG. 3, in a folding cylinder 50, the initial states of a cam mechanism 800 and pin action stop cam 810 provided outside the folding cylinder 50 are shown by dotted lines in the same drawing in regard to a pin mechanism 101 (102, 103) and folding blade mechanism 201 (202, 203) to facilitate understanding.

The folding device shown in FIG. 3 comprises the folding cylinder 50, a cutting cylinder 60 which is an adjacent cylinder upstream of the folding cylinder 50, and a jaw cylinder 70 which is an adjacent cylinder downstream of the folding cylinder 50, these being the rotating cylinders of this invention, and these cylinders are supported free to rotate by a frame F. In the figure, NR is a pair of nipping rollers. Further, a suitable delivery mechanism, not shown, is installed downstream of the jaw cylinder 70.

In the folding device shown in FIG. 3, the diameter of the folding cylinder 50 is 1.5 times the diameter of the cutting cylinder 60 and the same as the diameter of the jaw cylinder 70. The folding cylinder 50 comprises three pin mechanisms 101, 102, 103, three folding blade mechanisms 201, 202, 203, and three knife receptacles 301, 302, 303. The ratio of the diameter of the folding cylinder 50 to that of the other rotating cylinders is however not limited to these values and various settings are possible, e.g., the diameter of the folding cylinder 50 may be 2.5 times the diameter of the cutting cylinder 60. Further, the diameter of the jaw cylinder 70 need not be the same as the diameter of the folding cylinder 50, and provided that it has a predetermined ratio to the diameter of the cutting cylinder 60, it may be larger or smaller than the diameter of the folding cylinder 50.

The three pin mechanisms 101, 102, 103 are provided such that the pins 111, 112, 113 are free to rise and set at three equidistant positions on the outer circumferential surface of the folding cylinder 50.

The pin mechanism 101 (102, 103) comprises a pin action shaft 131 (132, 133) which is free to rotate (suffer an angular displacement) inside and near the outer circumferential surface of the folding cylinder 50 parallel to the shaft of the folding cylinder 50, an arm 151 (152, 153) fixed to an end extending from a side face (right-hand face in FIG. 1 in the embodiment shown) of the pin action shaft 131 (132, 133) on the side of the folding cylinder 50, and extending perpendicular to the rotation axis of the pin action shaft 131 (132, 133), a pin cam follower shaft 161 (162, 163) parallel to the rotation axis of the pin action shaft 131 (132, 133) on the free end side of the arm 151 (152, 153), two pin cam followers 171 (172, 173) which are free to rotate on the pin cam follower shaft 161 (162, 163) and free to come in contact with a pin action stop cam 810 and pin action rotation cam 820 described later, plural (five in the embodiment shown in FIG. 1) pin holders 121 (122, 123) disposed at suitable intervals on an inner part of the folding cylinder 50 of the pin action shaft 131 (132, 133), and attached so that they can move together according to the angular displacement of the pin action shaft 131 (132, 133), pins 111 (112, 113) attached to the tip of the free, bent ends of the approximately L-shaped pin holders 121 (122, 123), and a torsion bar 141 (142, 143) disposed in a hollow part of the pin action shaft 131 (132, 133) whereof one end is fixed to the folding cylinder 50 and the other end is fixed to the pin action shaft 131 (132, 133), and so that it tends to rotate the pin action shaft 131 (132, 133) in the anti clockwise direction of FIG. 3, i.e., to rotate the pin cam follower 171 (172, 173) attached to the pin action shaft 131 (132, 133) via the arm 151 (152, 153) and the pin cam follower shaft 161 (162, 163), in such a direction as to press the cam surfaces of the pin action stop cam 810 and pin action rotation cam 820 described later.

The three folding blade mechanisms 201, 202, 203 are provided such that folding blades 211, 212, 213 are free to rise and set in intermediate positions between the rising and falling positions of the pins 111, 112, 113 on the outer circumferential surface of the folding cylinder 50.

The folding blade mechanism 201 (202, 203) comprises a folding blade holder 221 (222, 223) which is free to rotate (suffer an angular displacement) inside and near the outer circumferential surface of the folding cylinder 50 parallel to the shaft of the folding cylinder 50, an arm 251 (252, 253) fixed to an end extending from a side face (right-hand end face in FIG. 1 in the embodiment shown) of the folding blade holder 221 (222, 223) on the side of the folding cylinder 50, and extending perpendicular to the rotation axis of the folding blade holder 231 (232, 233), a folding blade cam follower shaft 261 (262, 263) parallel to the rotation axis of the folding blade holder 221 (222, 223) on the free end side of the arm 251 (252, 253), two folding blade cam followers 271 (272, 273) which are free to rotate on the folding blade cam follower shaft 261 (262, 263) and free to come in contact with a folding blade action stop cam 840 and folding blade rotation cam 830 described later, one folding blade 211 (212, 213) disposed at a suitable angle on the tip side of part of the folding blade holder 221 (222, 223) inside the folding cylinder 50 so that it can displace in one piece according to the angular displacement of the folding blade holder 221 (222, 223), and a torsion bar 241 (242, 243) disposed in a hollow part of the folding blade holder 221 (222, 223) whereof one end is fixed to the folding cylinder 50 and the other end is fixed to the folding blade holder 221 (222, 223) so that it tends to rotate the folding blade holder 221 (232, 233) in the clockwise direction of FIG. 3, i.e., to rotate the folding blade cam followers 271 (272, 273) attached to the folding blade holder 221 (222, 223) via the arm 251 (252, 253) and the folding blade cam follower shaft 261 (262, 263), in such a direction as to press the cam surfaces of the folding blade action stop cam 840 and folding blade action rotation cam 830 described later.

The three knife receptacles 301, 302, 303 are provided in the vicinity of the rising and falling positions of the pins 111, 112, 113 on the outer circumferential surface on the downstream side in the rotation direction of the folding cylinder 50. The knife receptacles 301, 302, 303 are comprised of a material such as a synthetic resin so that they may engage with blades 61 and 62 of the cutting cylinder 60, described later.

The knives 61, 62 are provided on the cutting cylinder 60 at two equidistant positions on the outer circumferential surface of the cutting cylinder 60. The knives 61, 62 engage with the knife receptacles 301, 302, 303 of the folding cylinder 50, and printing web W transported between the two by the pair of nipping rollers NR is cut to a fixed length so as to obtain cut printed product WA.

Three jaw mechanisms 71, 72, 73 are provided on the jaw cylinder 70 at three equidistant positions on the outer circumferential surface of the jaw cylinder 70. The cut printed product WA is transferred from the folding cylinder 50 to the jaw cylinder 70. The jaw mechanisms 71, 72, 73 grip the cut printed product WA at positions facing the folding blades 211, 212, 213 of the folding cylinder 50.

The folding cylinder 50, cutting cylinder 60 and jaw cylinder 70 are so disposed and their rotation phases are so determined that when the folding device operates, they rotate at the same circumferential speed, the knives 61, 62 of the cutting cylinder 60 and the cutting receptacles 301, 302, 303 of the folding cylinder 50 face each other and engage at adjacent positions on the two cylinders, the jaw mechanisms 71, 72, 73 of the jaw cylinder 70 and the rising and falling positions of the folding blades 211, 212, 213 of the folding cylinder 50 face each other at nearby positions on the two cylinders, and the cut printed product WA can be transferred.

A cam mechanism 800 is disposed between the end face on which the pin cam followers 171 (172, 173) and folding blade cam followers 271 (272, 273) of the folding cylinder 50 are provided and the frame F so that the cam action stop cam 810, cam action rotation cam 820, folding blade action rotation cam 830 and the folding blade action stop cam 840 which are concentric with the rotation center of the folding cylinder 50 and whereof the outer circumferential surfaces are formed in a cam shape, are arranged in that order starting from the frame F, and so that the pin cam followers 171 (172, 173) and folding blade cam followers 271 (272, 273) respectively correspond with these cams (*4).

In order to make the pins 111 (112, 113) fall from the circumferential surface of the folding cylinder 50, the pin action stop cam 810 comprises a pin fall cam surface 819 whereof the distance of a predetermined range of the outer circumferential surface (range corresponding to a center angle alpha 1, FIG. 2) from the aforesaid rotation center is arranged to be less than from other outer circumferential surfaces.

This pin action stop cam 810 is so disposed that the pin cam followers 171 (172, 173) of the pin mechanism 101 (102, 103) to which the pins 111 (112, 113) belong and which holds the cut printed product WA in the transfer position, corresponds to the aforesaid pin falling cam surface 819 when the folding cylinder 50 is in rotation phase for transferring the cut printed product WA to the jaw cylinder 70 from the folding cylinder 50 (FIG. 3). A flange 811 of the pin action stop cam 810 is attached by a bolt B to a support BR attached to the frame F so that it can undergo an angular displacement within a predetermined angular range due to a circumferential guide surface BR1 provided on this support BR concentric with the rotation center of the folding cylinder 50.

Further, a control means 10 which displaces the pin action stop cam 810 around the rotation center of the folding cylinder 50 due to the circumferential guide surface BR1 of the aforesaid support BR, and a stop means 20 which stops the displaced pin action stop cam 810 in its displaced position, are provided in the pin action stop cam 810.

Specifically, a projecting member 11 which projects in a perpendicular direction to the rotation center of the folding cylinder 50 is attached at a suitable position on the flange 811 of the pin action stop cam 810, and a first pin member 12 which is free to rotate around the rotation center parallel to the shaft of the folding cylinder 50 is attached at the free end of the projecting member 11. A female penetration screw is provided at right angles to this rotation center in the first pin member 12.

A second pin member 13 which is free to rotate around the rotation center parallel to the shaft of the folding cylinder 50 is further provided via a bracket 14 at a suitable position on the frame F. A throughhole is provided in the second pin member 13 perpendicular to its rotation center so that it can share a center axis with the female penetration screw of the first pin member 12.

A male screw member 15 is further provided which passes through the throughhole of the second pin member 13, and whereof a male screw part having a suitable length at its end screws into the female penetration screw of the first pin member 12. A control mechanism 16 which rotates the male screw member 15 is attached to the end of the male screw member 15 on the side of the second pin 13, and forms the control means 10. In the embodiment shown, the control mechanism 16 is an index handle, but the invention is not limited to this, and may for example be connected directly or via a transmitting means, not shown, to a motor, not shown, controlled by a suitable control means, not shown, to perform rotation in predetermined amounts On the other hand, a plate member 21 which projects in a perpendicular direction to the rotation center of the folding cylinder 50 and having a suitable length around the rotation center of the folding cylinder is attached at a different position to the aforesaid projecting member 11 of the flange 811 of the pin action stop cam 810. A brake mechanism 22 comprising brake pads 23 on both sides of this plate member 21 is provided so as to form a stop means 20. The brake pads 23 are made to come in intimate contact with both sides of the plate member 21 and grip it by supplying compressed air to the brake mechanism 22.

The free end of the second pin member 13 may for example be split into two pieces up to the throughhole (*6). Another stop means 20 is formed by providing a screw type lock means 24 which tightens these split parts by a screw which can be controlled by a lock lever 25. After rotating the male screw member 15, the male screw member 15 can be locked by the lock means 24 to prevent free rotation of the male screw member 15.

In order to make the folding blade 211 (212, 213) project from the circumferential surface of the folding cylinder 50, the folding blade action stop cam 840 comprises a folding blade projection cam surface 849 in one position wherein the distance of a predetermined range of the outer circumferential surface (range corresponding to a center angle alpha2, FIG. 2) from the rotation center is made less than that of other outer circumferential surfaces. This folding blade action stop cam 840 is so disposed that when the folding cylinder 50 is in a rotation phase to transfer the cut printed product WA from the folding cylinder 50 to the jaw cylinder 70, the cam followers 271 (272, 273) of the folding blade mechanism 201 (202, 203) to which the folding blades 211 (212, 213) which push out the cut printed product WA in the transfer position belong, and the folding blade projection cam surface 849, correspond with each other (FIG. 3), and is fixed by a bolt, not shown, to an end opposite the end face of the folding cylinder 50, of a sleeve S attached to the frame F supporting the axis of the folding cylinder 50 free to rotate via a bearing.

The pin action rotation cam 820 comprises an outer circumferential surface whereof the distance from the rotation center is less than that of the pin falling cam surface 819 of the aforesaid pin action stop cam 810, and a masking cam surface 829 whereof the distance of a predetermined range (range corresponding to a center angle alpha3, FIG. 2) from the rotation center is made the same as that of other outer circumferential surfaces excepting the pin falling cam surface 819 of the aforesaid pin action stop cam 810 at a point which divides its outer circumferential surface into two equal parts. The folding blade action rotation cam 830 comprises an outer circumferential surface whereof the distance from the rotation center is less than that of the folding blade projection cam surface 849 of the aforesaid folding blade action stop cam 840, and a masking cam surface 839 whereof the distance of a predetermined range (range corresponding to a center angle alpha4, FIG. 2) from the rotation center is made the same as that of other outer circumferential surfaces excepting the folding blade projection cam surface 849 of the aforesaid folding blade action stop cam 840 at a point which divides its outer circumferential surface into two equal parts.

The pin action rotation cam 820 and the folding blade action rotation cam 830 are assembled in one piece so that the two masking cam surfaces 829, 839 are shifted in phase by a predetermined angle beta (FIG. 2), and are attached free to rotate via bearings B1, B2 on the outer circumferential surface of the sleeve S. A gear 821 is provided on the outer circumferential surface, near the frame F, of the boss of the pin action rotation cam 820 and the folding blade action rotation cam 830 which were assembled in one piece (hereafter, the pin action rotation cam 820 and the folding blade action rotation cam 830 assembled in one piece will be referred to as "the one-piece rotation cam 820, 830"). Further, an intermediate shaft 825 is provided free to rotate via a sleeve and a bearing in the throughhole of the frame F. This gear 821 is made to engage with a gear 822 attached free to rotate in one piece with the intermediate shaft 825, at the end of the intermediate shaft 825 projecting inside the frame F (opposite side to the folding cylinder 50), and a gear 824 is attached free to rotate with the intermediate shaft 825, at the end of the intermediate shaft 825 projecting outside the frame F.

A rotating shaft 901 is also provided on the outer surface of the frame F, and is supported free to rotate by the frame F and a bracket 950 attached to the frame F.

A gear 902, which engages with the aforesaid gear 824, is attached to the rotating shaft 901 so that it is free to rotate in one piece with the rotating shaft 901, and a gear 903 which engages with a drive transmission gear, not shown, is also attached to the rotating shaft 901 so that it is free to rotate relative to the rotating shaft 901. A clutch mechanism 910 controlled by a control lever 915 is further provided in relation to the rotating shaft 901.

The clutch mechanism 910 comprises a fixed element 911 which is fixed to the bracket 950, and a moving element 912 which is free to rotate in one piece with the rotating shaft 901, is displaced in an axial direction of the rotating shaft 901 by operating the control lever 915, and can be selectively connected to either the aforesaid gear 903 or the aforesaid fixed element 911.

Straight run is performed as follows:

The moving element 912 of the clutch mechanism 910 is connected to the fixed element 911, and the one-piece rotation cam 820, 830 is stopped relative to the pin action stop cam 810 which has been stopped with a predetermined phase, and the folding blade action stop cam 840 which is fixed with a predetermined fixed phase on the sleeve S, so that the masking cam surface 829 of the pin action rotation cam 820 does not overlap (does not mask) the pin falling cam surface 819 of the pin action stop cam 810, and the masking cam surface 839 of the folding blade action rotation cam 930 does not overlap (does not mask) the folding blade projection cam surface 849 of the folding blade action stop cam 840, as shown for example in FIG. 2.

Collect run is performed as follows:

The moving element 912 of the clutch mechanism 910 is connected to the gear 903, a predetermined rotation phase is taken as a starting phase relative to the rotation of the folding cylinder 50, and the one-piece rotation cam 820, 830 is rotated with a predetermined rotation ratio relative to the rotation of the folding cylinder 50, so that the masking cam surface 829 of the pin action rotation cam 820 overlaps (masks) the pin falling cam surface 819 of the pin action stop cam 810, and the masking cam surface 839 of the folding blade action rotation cam 930 overlaps (masks) the folding blade projection cam surface 849 of the folding blade action stop cam 840, with a predetermined timing.

In the embodiment shown in the figures, "predetermined" refers to the case where the phase of each cam of the cam mechanism 800 shown in FIG. 2 and the phase of the folding cylinder 50 shown in FIG. 3 are respectively taken as starting phases, and the one-piece rotation cam 820, 830 performs ¾ rotation for one rotation of the folding cylinder 50 in a collect run action.

Next, the timing adjustment of the falling of the pins 111 (112, 113) from the circumferential surface of the folding cylinder 50 relative to the projection of the folding blades 211 (212, 213) from the circumferential surface of the folding cylinder 50 in the aforesaid construction, will be described.

As is clear from the above description, the projection of the folding blades 211 (212, 213) from the circumferential surface of the folding cylinder 50 to transfer the cut printed product WA held on the circumferential surface of the folding cylinder 50 to the jaw mechanism 71 (72, 73) of the jaw cylinder 70, is performed by displacing the folding blade cam followers 271 (272, 273) of the folding blade mechanism 201 (202, 203) according to the folding blade projection cam surface 849 of the folding blade action stop cam 840. Further, the falling of the pins 111 (112, 113) on the circumferential surface of the folding cylinder 50 to release the cut printed product WA held on the circumferential surface of the folding cylinder 50 so it can be transferred to the jaw mechanism 71 (72, 73) of the jaw cylinder 70, is performed by displacing the pin cam followers 171 (172, 173) of the pin mechanism 101 (102, 103) according to the pin falling cam surface 819 of the pin action stop cam 810.

Therefore, to adjust the timing with which the pins 111 (112, 113) fall from the circumferential surface of the folding cylinder 50 relative to the projection of the folding blades 211 (212, 213) from the circumferential surface of the folding cylinder 50, it is sufficient to vary the phase of the pin action stop cam 810 around the rotation center of the folding cylinder 50 relative to the phase of the folding blade action stop cam 840 around the rotation center of the folding cylinder 50.

For this purpose, in the aforesaid construction, the stopping action of the stop means 20 on the pin action stop cam 810 is eliminated. Specifically, the lock lever 25 of the lock mechanism 24 is operated to loosen the screw of the lock mechanism 24, and release the male screw member 15. Also, the brake mechanism 22 is released to separate the brake pads 23 from the plate member 21.

Next, the male screw member 15 is rotated in a suitable direction by operating the control mechanism 16. The pin action stop cam 10 then rotates via the projecting member 11 according to the inner circumferential guide surface BR1 of the supporting member BR due to the screw action of the female screw part of the first pin 13 and the male screw part of the male screw member 15, the phase of the pin action stop cam 810 around the rotation center of the folding cylinder 50 changes, and the timing with which the pins 111 (112, 113) fall on the circumferential surface of the folding cylinder 50 relative to the projection of the folding blades 211 (212, 213) from the circumferential surface of the folding cylinder 50 is thereby changed and adjusted. In the embodiment shown in the diagram, an adjustment tolerance of 20 degrees or more can be obtained.

In the embodiment shown in the diagram, when the pin action stop cam 810 is displaced in the anti-clockwise direction of FIG. 2, the timing with which the pins 111 (112, 113) fall on the circumferential surface of the folding cylinder 50 relative to the projection of the folding blades 211 (212, 213) from the circumferential surface of the folding cylinder 50, is advanced, and when the pin action stop cam 810 is displaced in the clockwise direction of FIG. 2, the timing with which the pins 111 (112, 113) fall on the circumferential surface of the folding cylinder 50 relative to the projection of the folding blade 211 (212, 213) from the circumferential surface of the folding cylinder 50, is retarded.

When the timing with which the pins fall on the circumferential surface of the folding cylinder 50 reaches a desired timing, the brake mechanism 22 is operated, and the brake pads 23 are brought into pressure contact with the plate member 21 so that the plate member is firmly held between them. Also, the lock lever 25 is operated to tighten the screw of the lock mechanism 24, and firmly lock the male screw member 15.

In the embodiment shown in the diagram, the brake mechanism 22 and lock mechanism 24 are used in conjunction as the stop means 20, but the pin action stop cam 810 can be stopped in the stop position after displacement by either of these mechanisms alone.

Due to the aforesaid construction, this invention offers the following advantages.

Firstly, in a pin action timing adjustment device of a folding cylinder or folding device wherein a change-over between straight run and collect run is performed in one operation for a folding blade action and a pin action, adjustment of a timing with which pins fall on the circumferential surface of a folding cylinder relative to the projection of folding blades from the circumferential surface of the folding cylinder, can be very easily performed by displacing a pin action stop cam around the rotation center of the folding cylinder regardless of whether the folding device is operating or not operating. As a result, when paper held on the circumferential surface of the folding cylinder by the pins is lifted up and transferred to a jaw cylinder by projection of the folding blades, the position where the paper is pushed out being taken as a fold, problems of paper creasing or bending, difficulty of maintaining a constant fold position, enlargement of the holes of the pins holding the paper with subsequent tearing of the paper, and damage to the paper in transferring it to the jaw cylinder, are completely resolved.

Secondly, in performing the adjustment by a helical gear of the prior art, the adjustment tolerance was only of the order of 10 degrees at most, but according to this invention a sufficient adjustment tolerance of 20 degrees or more can be obtained in the timing with which the pins fall on the folding cylinder circumferential surface relative to the projection of the folding blades from the folding cylinder circumferential surface.

Thirdly, the construction of the device to perform the aforesaid adjustment is exceedingly simple, so the number of parts can be reduced, manufacturing costs can be reduced, faults do not often occur, and maintenance is easy.

Having described specific preferred embodiments of the present invention with reference to the accompanying drawings, it will be appreciated that the present invention is not limited to those precise embodiments, and that various changes and modifications can be effected therein by one of the ordinary skill in the art without departing from the scope of the invention as defined by the appended claims.

Throughout the specification, the term "rotating cam" can be used instead of "rotation cam" and the term "fixed cam" can be used instead of "stop cam".

The present disclosure relates to subject matter contained in priority Japanese Patent Application No. HEI 11-202202, filed on Jul. 15, 1999, the contents of which are herein expressly incorporated by reference in its entirety.

What is claimed is:

1. A pin action timing adjustment device for a folding cylinder, comprising:

a folding cylinder, plural pin mechanisms which cause pins provided in said folding cylinder to rise and set on the outer circumferential surface of said folding cylinder, plural folding blade mechanisms which cause folding blades to rise and set on the outer circumferential surface of said folding cylinder in conjunction with the rising and setting of said pins provided in said folding cylinder, a pin action fixed cam having the same center as the rotation center of said folding cylinder, a folding blade action fixed cam having the same center as the rotation center of said folding cylinder, a pin action rotating cam and folding blade action rotating cam formed in one piece having the same rotation center as the rotation center of the folding cylinder, which can selectively change over between a state wherein the cams rotate in a predetermined relation to the rotation of the folding cylinder and a state wherein they have stopped in a predetermined relation to said pin action fixed cam and folding blade action fixed cam, a pin cam follower provided in said pin mechanisms which causes said pins to rise and set from the outer circumferential surface of the folding cylinder together with the pin action fixed cam and pin action rotating cam, a folding blade cam follower provided in said folding blade mechanisms which causes said folding blades to rise and set from the outer circumferential surface of the folding cylinder together with the folding blade action fixed cam and folding blade action rotating cam, a control mechanism linked to the pin action fixed cam which causes the pin action fixed cam to undergo an angular displacement around its center, and a stop mechanism connectable to the pin action fixed cam, and which stops the pin action fixed cam with a phase whereby it was displaced by said control mechanism.

2. A folding device comprising a cutting cylinder, folding cylinder and jaw cylinder, wherein said device comprises a folding cylinder pin action timing adjustment device as defined in claim 1.

3. A pin action timing adjustment device as defined in claim 1, wherein said stop mechanism stops said pin action fixed cam by locking said control mechanism.

4. A pin action timing adjustment device as defined in claim 1, wherein said stop mechanism stops said pin action fixed cam by locking said pin action fixed cam.

5. A pin action timing adjustment device for a folding device wherein rotating cylinders are supported such that they are free to rotate on opposite frames, plural pin mechanisms are provided which cause plural pins arranged in the axial direction of the rotating cylinders to rise and set at equidistant positions on the outer circumferential surface of the rotating cylinders, and folding blade mechanisms of identical number to said pin mechanisms are provided which cause folding blades parallel to a rotating shaft to rise and set together in relation to the falling of said pins between the rising and falling positions of said pins on the rotating cylinders, wherein paper is pushed through and held on the circumference of the rotating cylinders due to the rising of the pins, the paper is transferred to an adjacent cylinder due to the falling of the pins and the rising of the blades and the transfer position is a fold, wherein this device can change over selectively between a straight run action or a collect run action, and comprising:

a pin action fixed cam provided between the rotating cylinders and frame, having the same center as the rotation center of the rotating cylinders, and whereof the outer circumferential surface is formed as a cam surface, a folding blade action fixed cam provided between the rotating cylinders and frame, having the same center as the rotation center of the rotating cylinders, and whereof the outer circumferential surface is formed as a cam surface, a pin action rotating cam and folding blade action rotating cam provided so that these two cams form one piece between said pin action fixed cam and said folding blade action fixed cam, have the same center as the rotation center of the rotating cylinders, have circumferences formed as cam surfaces, and can selectively change over between a state wherein the cams rotate in a predetermined relation to the rotation of the folding cylinder and a state wherein they have stopped in a predetermined relation to said pin action fixed cam and folding blade action fixed cam, a pin cam follower provided in said pin mechanisms whereof the circumferential surface comes in contact with the cam surfaces of said pin action fixed cam and pin action rotating cam, and which causes the pins to rise and set from the outer circumferential surface of the folding cylinder together with the pin action fixed cam and pin action rotating cam, a folding blade cam follower provided in said folding blade mechanisms whereof the circumferential surface comes in contact with the cam surfaces of said folding blade action fixed cam and said folding blade action rotating cam, and which causes the folding blades to rise and set from the outer circumferential surface of the folding cylinder together with the folding blade action fixed cam and folding blade action rotating cam, a control mechanism linked to the pin action fixed cam which causes the pin action fixed cam to undergo an angular displacement around its center, and a stop mechanism connectable to the pin action fixed cam, and which stops the pin action fixed cam with a phase whereby it was displaced by said control mechanism.

6. A pin action timing adjustment device as defined in claim 5, wherein said stop mechanism stops said pin action fixed cam by locking said control mechanism.

7. A pin action timing adjustment device as defined in claim 5, wherein said stop mechanism stops said pin action fixed cam by locking said pin action fixed cam.

* * * * *